US005454336A

United States Patent [19]

Iwasaki

[11] Patent Number: 5,454,336

[45] Date of Patent: Oct. 3, 1995

[54] WORK-SHEET RETAINER INCLUDING APERTURED SUPPORT PLATE

[75] Inventor: Toshiaki Iwasaki, Nagoya, Japan

[73] Assignee: Brother Kogyo Kabushiki Kaisha, Aichi, Japan

[21] Appl. No.: 221,241

[22] Filed: Mar. 31, 1994

[30] Foreign Application Priority Data

Apr. 23, 1993 [JP] Japan ..... 5-097716

[51] Int. Cl.[6] ..... D05B 21/00

[52] U.S. Cl. ..... 112/470.16; 112/475.06; 112/475.09

[58] Field of Search ..... 112/121.12, 114, 112/121.15, 147, D162; 38/102.2, 102.91

[56] References Cited

U.S. PATENT DOCUMENTS

| | | | |
|---|---|---|---|
| 4,682,551 | 7/1987 | Toman | 38/102.91 X |
| 4,754,719 | 7/1988 | Takken | 112/121.15 X |
| 4,793,272 | 12/1988 | Scholl et al. | 112/121.15 |
| 4,813,362 | 3/1989 | Vogt et al. | 112/121.12 |
| 4,819,572 | 4/1989 | Scholl et al. | 112/121.15 |
| 4,821,659 | 4/1989 | Morii et al. | 112/121.15 |
| 4,883,006 | 11/1989 | Marii et al. | 112/121.12 |
| 4,911,091 | 3/1990 | Scholl et al. | 112/121.15 X |
| 5,188,044 | 2/1993 | Brockmann | 112/121.15 |
| 5,272,994 | 12/1993 | Scholl et al. | 112/114 X |

FOREIGN PATENT DOCUMENTS

| | | | |
|---|---|---|---|
| 1660832 | 2/1972 | Germany | 112/121.15 |
| 2230542 | 10/1990 | United Kingdom | 112/121.15 |

*Primary Examiner*—Clifford D. Crowder
*Assistant Examiner*—Ismael Izaguirre
*Attorney, Agent, or Firm*—Oliff & Berridge

[57] ABSTRACT

Apparatus and method for retaining a work sheet on a support plate, the plate having opposite major surfaces, the apparatus including (a) a table, (b) a support plate with one or more air passages, and (c) a suction device. The method for retaining the sheet and stitching the sheet including the steps of (A) placing the sheet on one major surface of the supporting plate, (B) folding and inserting an excess of the sheet which overflows one major surface of the plate, between the other major surface of the plate and the table which is positioned adjacent to the other major surface of the plate, (C) sucking air through the one or more passages of the plate so as to retain an inner portion of the sheet supported by one major surface of the plate, on that major surface, and (D) forming stitches on the sheet.

14 Claims, 8 Drawing Sheets

WORK-SHEET RETAINER INCLUDING APERTURED SUPPORT PLATE

BACKGROUND OF THE INVENTION

1. Field of the Invention

The present invention relates to a work-sheet retaining apparatus for retaining a work sheet on a support plate.

2. Related Art Statement

There is known a work-sheet retaining device which retains a work sheet on a support plate such that an excessive outer peripheral portion of the work sheet which overflows the upper surface of the support plate is folded and inserted between the lower surface of the support plate and the upper surface of a table disposed below the support plate. A sewing machine incorporating the retaining device is disclosed in U.S. Pat. No. 4,821,659. The disclosed sewing machine automatically (a) folds an excessive outer peripheral portion of a "pocket" material or cutting as a first work sheet, (b) superposes the pocket cutting on a second work sheet such as a front-body cutting of a garment, and (c) attaches the pocket to the front body by forming stitches along the folded peripheral edge of the pocket.

The operation of the above sewing machine is detailed below, by reference to FIGS. 6(*a*) to 6(*f*) which show respective steps (a) to (f) carried out by a sewing system 8 in accordance with the present invention. Those steps are commonly effected by the prior sewing machine and the invention sewing system.

In Step (a) of FIG. 6(*a*), a pocket cutting, P, is placed on a support plate 24 disposed above a table plate 14 of the sewing machine, and a work-sheet folding frame 28 is pressed on the support plate 24. Thus, an excessive outer peripheral portion, P1, of the pocket cutting P which is overflowing the upper surface of the support plate 24 is folded downward by the folding frame 28 along the outer peripheral edge of the support plate 24.

In Step (b) of FIG. 6(*b*), a plurality of folding members 35 are actuated by respective air cylinders 33 supported on a common folding-member holder 32, so that the folding members 35 are moved toward the lower surface of the support plate 24. Consequently, the peripheral portion P1 of the pocket cutting P is folded onto the lower surface of the support plate 24.

In Step (c) of FIG. 6(*c*), the work-sheet folding frame 28 and the folding-member holder 32 are moved downward as a unit onto a front-body cutting, W, provided on the table plate 14.

In Step (d) of FIG. 6(*d*), the air cylinders 33 are driven to move the folding members 35 away from beneath the support plate 24.

In Step (e) of FIG. 6(*e*), the work-sheet folding frame 28 and the folding-member holder 32 are moved upward as a unit.

In Step (f) of FIG. 6(*f*), while the pocket cutting P is pressed on the front-body cutting W by a presser plate 19, the support plate 24 is removed from the cutting P. Subsequently, the pocket cutting P whose peripheral portion P1 is folded back on the front-body cutting W is sewn along the folded peripheral edge thereof by a stitch-forming device. Thus, the pocket P is attached to the front body W.

The prior sewing machine, however, suffers from the problem that the work sheet P retained on the support plate 24 may move out of position due to vibration produced in Steps (c) to (e), in particular, Step (e) where neither the folding frame 28 nor the presser plate 19 is pressed on the pocket cutting P.

U.S. Pat. No. 4,813,362 or No. 4,819,572 discloses another work-sheeting retaining device including a support plate on which a work sheet is placed; a table plate which has holes formed through thickness thereof, like holes 83 of the table plate 14 shown in FIGS. 6(*a*) to 6(*f*); and (B) a vacuum device which sucks air from above the table plate through the holes thereof. In this device, the support plate is retained by air suction on the table plate, with an excessive outer peripheral portion of the work sheet being pinched between the support and table plates. Thus, the work sheet is more or less prevented from moving out of position on the support plate.

The second prior retaining device ensures that the outer peripheral portion of the work sheet is pinched with increased force between the support and table plates. However, an inner portion of the work sheet supported on the upper surface of the support plate is free of the force to fix it in position. Thus, the prior device suffers from the problem that the work sheet may move out of position and accordingly wrinkle on the support plate.

SUMMARY OF THE INVENTION

It is therefore an object of the present invention to provide a work-sheet retaining apparatus for retaining a work sheet on a support plate while effectively preventing the support plate work sheet from moving out of position on the work sheet.

It is a second object of the present invention to provide a process of forming stitches into a work sheet by using a work-sheet retaining apparatus described above.

These objects have been achieved by the present invention.

According to a first aspect of the present invention, there is provided a work-sheet retaining apparatus for retaining a work sheet on a support plate, the support plate having opposite major surfaces, the apparatus comprising a table, the work sheet being placed on one of the opposite major surfaces of the support plate such that an outer peripheral portion of the work sheet which overflows the one major surface is inserted between the other major surface of the support plate and the table; the support plate having at least one air passage opening in the one major surface; and a suction device which sucks air through the at least one air passage of the support plate so as to retain an inner portion of the work sheet inside the outer peripheral portion thereof, on the one major surface of the support member.

In the work-sheet retaining apparatus constructed as described above, the support plate has one or more air passages opening in one major surface thereof, e.g., upper surface thereof. When the suction device sucks air, air flows through the air passage or passages formed in the support plate. Therefore, the air around the one major surface of the support plate on which the work sheet is placed is sucked by the suction device and consequently an inner portion of the work sheet supported on the one major surface of the support plate is held or retained on the support plate. Thus, the work sheet is surely fixed on the support plate. The air passage or passages may be either (a) one or more holes formed through thickness of the support plate, or (b) a hollow space (e.g. cavity) formed inside the support plate and one or more externally opening holes communicating with the hollow space. In the latter case, the suction device communicates with the hollow space of the support plate to suck air through the opening holes and the hollow space.

According to a preferred feature of the first aspect of the present invention, the table comprises a table plate having at least one first hole formed through thickness thereof, the support plate being disposed on one side of the table plate, the support plate having, as the at least one air passage thereof, at least one second hole formed through thickness thereof, the suction device being disposed on the other side of the table plate and sucking air through the at least one first hole of the table plate and the at least one second hole of the support plate so as to retain the support plate on the table plate and simultaneously retain the inner portion of the work sheet on the one major surface of the support plate.

According to another feature of the first aspect of the present invention, the at least one second hole of the support plate comprises a plurality of second holes. The at least one second hole of the support plate may consist solely of a plurality of second holes formed in an outer peripheral portion of the support plate. In the case where the support plate has a rectangular shape, the plurality of second holes of the support plate may be formed along three sides of the rectangular support plate.

According to yet another feature of the first aspect of the present invention, the at least one second hole of the support plate has a circular cross section whose diameter falls in a range of 0.3 to 4.0 mm, more preferably, in a range of 0.8 to 2.0 mm.

According to a further feature of the first aspect of the present invention, the retaining apparatus further comprises a displacing device which removes the support plate from the work sheet; and a pressing device which presses the work sheet on the table while the support plate is removed from the work sheet by the displacing device.

According to another feature of the first aspect of the present invention, the retaining apparatus further comprises a first folding device which folds the outer peripheral portion of the work sheet which overflows the one major surface of the support plate, onto at least one side surface of the support plate; and a second folding device which folds the outer peripheral portion of the work sheet folded on the at least one side surface of the support plate, onto the other major surface of the support plate.

According to a second aspect of the present invention, there is provided a process of forming stitches into a work sheet, comprising the steps of, placed the work sheet on one of opposite major surfaces of a support plate such that an outer peripheral portion of the work sheet which overflows the one major surface is inserted between the other major surface of the support plate and a table, the support plate having at least one air passage opening in the one major surface; sucking air through the at least one air passage of the support plate so as to retain an inner portion of the work sheet inside the outer peripheral portion thereof, on the one major surface of the support plate; and forming the stitches into the work sheet.

The stitch-forming process arranged as described above enjoys the same advantages as described above with respect to the work-sheet retaining apparatus according to the first aspect of the invention. Since the work sheet is effectively prevented from moving out of position or wrinkling on the support plate, stitches are formed into the work sheet at respective desirable positions with high accuracy. Thus, the quality of the sewing product is much improved.

According to a preferred feature of the second aspect of the present invention, the stitch-forming process further comprises the steps of removing the support plate from the work sheet; and pressing, using a pressing device, the work sheet on the table while the support plate is removed from the work sheet, wherein the step of forming the stitches comprises forming, using a stitch-forming device, the stitches into the work sheet being pressed by the pressing device after the support plate has been removed from the work sheet.

According to another feature of the second aspect of the present invention, the stitch-forming process further comprises the steps of placed, when the work sheet as a first work sheet is placed on the support plate, a second work sheet on the table; and superposing the first work sheet on the second work sheet, wherein the step of forming the stitches comprises forming the stitches into the first and second work sheets to attach the first work sheet to the second work sheet.

According to yet another feature of the second aspect of the present invention, the stitch-forming process further comprises the step of disposing the support plate on one side of a table plate as the table, and disposing the suction device on the other side of the table plate, wherein the step of sucking air comprises sucking air through at least one first hole formed through thickness of the table plate and at least one second hole formed through thickness of the support plate so as to retain the support plate on the table plate and simultaneously retain the inner portion of the work sheet on the one major surface of the support plate.

cl BRIEF DESCRIPTION OF THE DRAWINGS

The above and optional objects, features, and advantages of the present invention will be better understood by reading the following detailed description of preferred embodiments of the invention when considered in conjunction with the accompanying drawings, in which.

Figure 1:
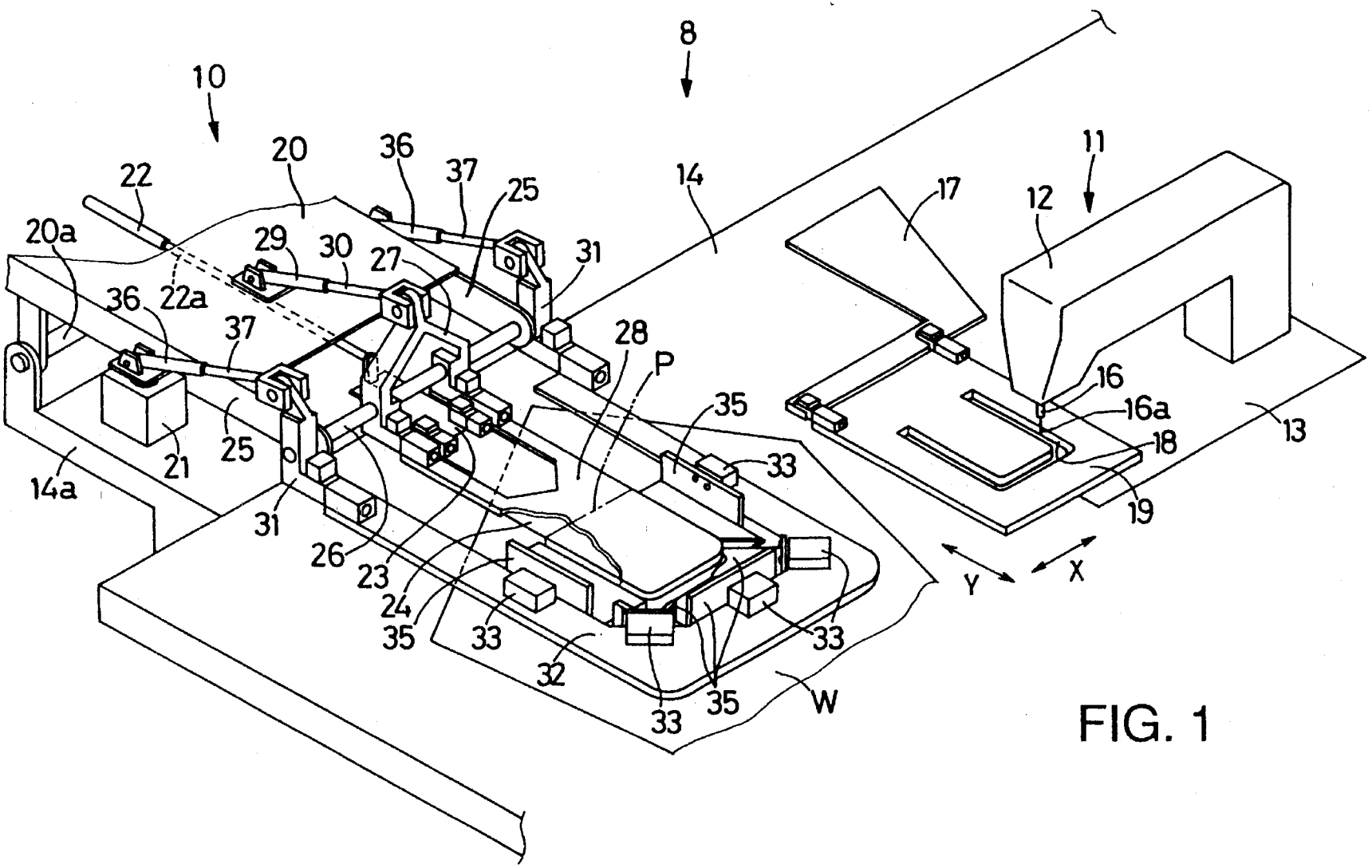
FIG. 1 is a perspective view of a sewing system including a work-sheet retaining apparatus in accordance with the present invention.
Figure 7:
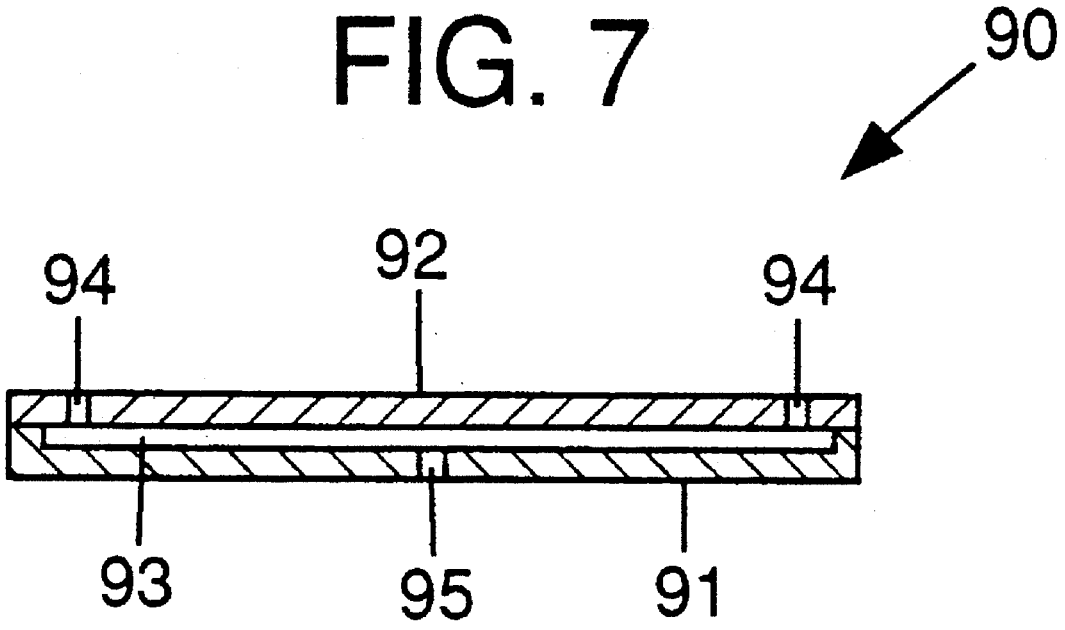

FIGS. 6(*a*), 6(*b*), 6(*c*), 6(*d*), 6(*e*), and 6(*f*) are views showing respective steps carried out by the retaining apparatus of FIG. 1 for folding an outer peripheral portion of a work sheet; and FIG. 7 is a cross-sectional view of another work-sheet support plate used in a second embodiment of the present invention.

DETAILED DESCRIPTION OF THE PREFERRED EMBODIMENTS

Referring first to FIG. 1, there is shown a sewing system 8 to which the present invention is applied. The sewing system 8 includes a work-sheet retaining apparatus 10 and a sewing machine 11.

Figure 4:
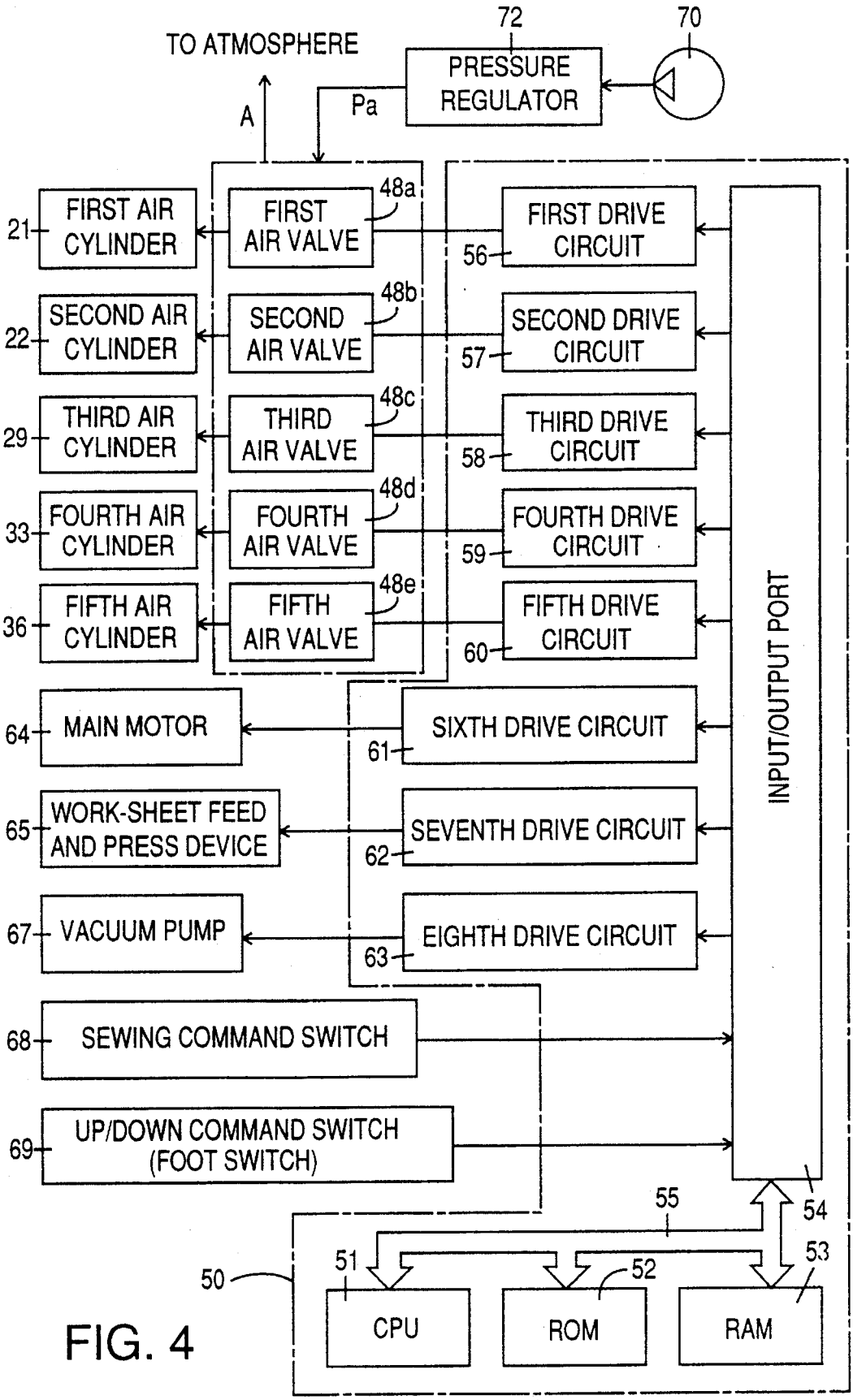
FIG. 4 is a diagrammatic view of the electric construction of a control device of the sewing system of FIG. 1.

As shown in FIG. 1, the sewing machine 11 includes an arm 12 and a bed 13. The arm 12 supports a needle bar 16 to the bottom end of which a sewing needle 16*a* is secured, such that the needle bar 16 is vertically reciprocatable by a main motor 64 (FIG. 4). The bed 13 incorporates a threadloop catcher (not shown) which cooperates with the sewing needle 16*a* to serve as a stitch-forming device.

The work-sheet retaining apparatus 10 includes a table plate 14 the upper surface of which is flush with the upper surface of the bed 13 of the sewing machine 11. Above the table plate 14, is disposed a work-sheet feed arm 17 to which a work-sheet presser plate 19 is detachably secured. The feed plate 19 has a needle-guide groove 18 formed through thickness thereof. As shown in FIG. 6(*f*), the presser plate 19 is pressed on a first work sheet, P, such as a "pocket" cutting, whose outer peripheral portion, P1, is folded and which is superposed on a second work sheet, W, such as a "front body" cutting of a garment. The feed arm 17 feeds, in X and Y directions indicated at arrows in FIG. 1, the presser plate 19 and accordingly the pocket and frontbody cuttings P, W pressed on the table plate 14 by the presser plate 19, from one the table plate 14 of the retaining apparatus 10 to the operative position of the sewing machine 11 where the pocket P is sewn to the front body W by the sewing needle 16*a* of the sewing machine 11.

The table plate 14 includes an extended portion 14*a* on which is disposed an automatic work-sheet folding device for automatically folding the outer peripheral portion P1 of the pocket cutting P. The work-sheet folding device includes a support member 20 which is pivotable about a first axis member 20*a* fixed to the extended portion 14*a*. The support member 20 is pivoted about the axis member 20*a* by a first air cylinder 21 fixed to the extended portion 14*a*. A second air cylinder 22 is fixed to the lower surface of the support member 20. The air cylinder 22 has a piston 22*a* to the free end of which a support-plate holder 23 is secured. A generally rectangular, work-sheet support plate 24, on which the pocket cutting P is to be placed, is detachably secured at the base end thereof to the support plate holder 23. The shape of the work-sheet support plate 24 defines the profile of the pocket to be produced from the pocket cutting P. The support member 20 includes a pair of axis holders 25, 25 which cooperate with each other to support a second axis member 26 on which a folding-frame holder 27 pivotally fits. A work-sheet folding frame 28 is detachably secured at the base end thereof to the folding-frame holder 27. A third air cylinder 29 is fixed to the upper surface of the support member 20, and has a piston 30 pivotally connected to the top end of the folding-frame holder 27.

Figure 2:
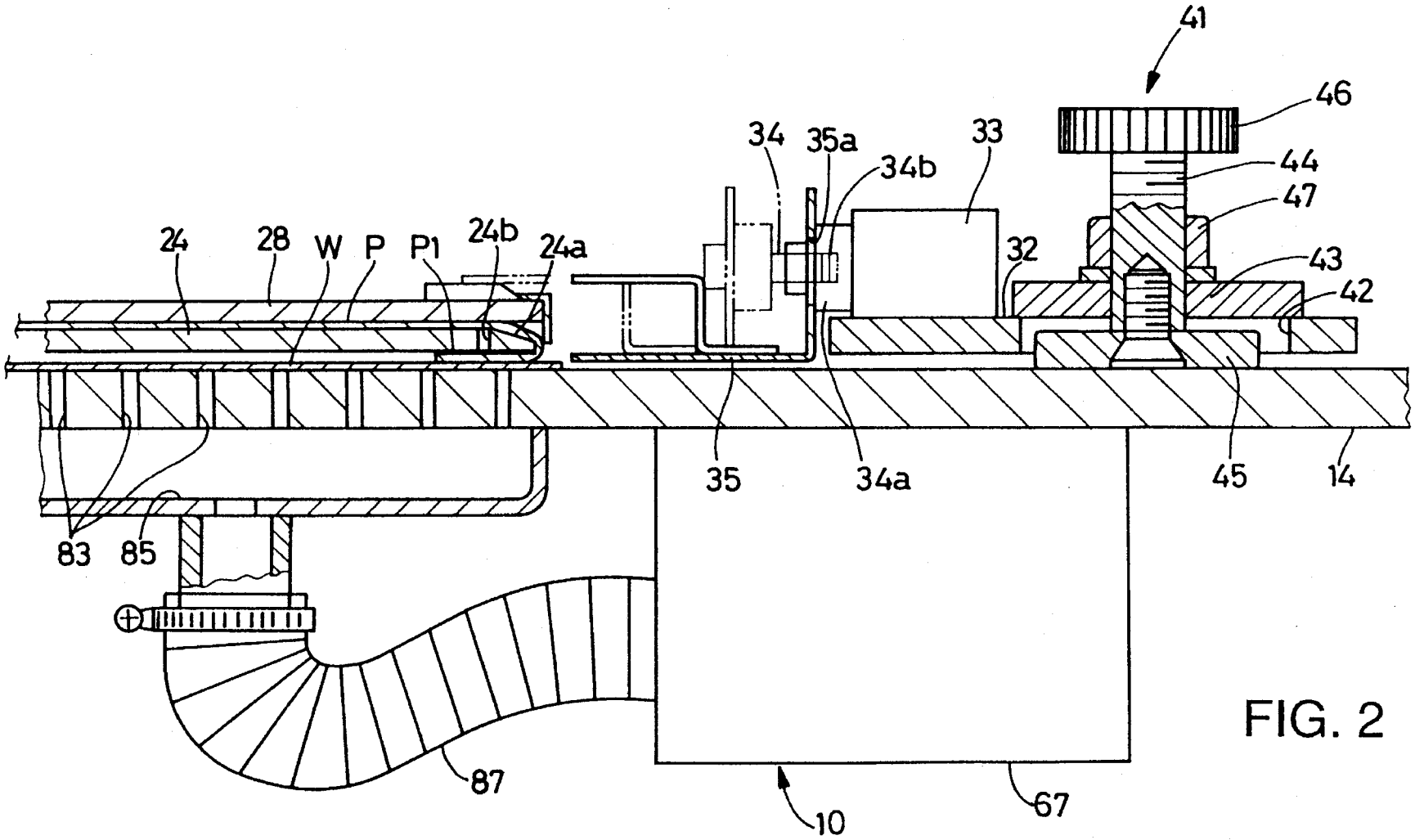
FIG. 2 is a view of a cross section of the retaining apparatus of FIG. 1.

A pair of support blocks 31, 31 pivotally fit on opposite ends of the second axis member 26, respectively. A generally U-shaped, folding-member holder 32 is detachably secured at two base ends thereof to the pair of support blocks 31, 31, respectively. The folding-member holder 32 is a flat member formed of a plate material. On the folding-member holder 32, five fourth air cylinders 33, 33, 33, 33, 33 are mounted such that the five air cylinders 33 cooperate with each other to surround the work-sheet folding frame 28. Each of the five air cylinders 33 has a piston 34 to the tip of which is secured a mount member 34*a* to which a work-sheet folding member 35 is secured. As shown in FIG. 2, each of the five folding members 35 includes an upright portion having a pair of vertical slots 35*a*, 35*a* formed through thickness thereof. Each folding member 35 is secured to a corresponding mount member 34*a* by fastening a pair of screws 34*b*, 34*b* thereto through the respective vertical slots 35*a*, 35*a*. By fastening and loosening the screws 34*b*, 34*b*, the vertical position of each folding member 35 may be adjusted relative to the upper surface of the table plate 14. A pair of fifth air cylinders 36, 36 are pivotally secured at base ends thereof to opposite side faces of the support member 20, respectively, and the air cylinders 36, 36 have respective pistons 37, 37 pivotally connected to the top ends of the corresponding support blocks 31, 31.

In the present embodiment, the first air cylinder 21 serves as an actuator for pivoting the support member 20, thereby pivoting the work-sheet support plate 24, work-sheet folding frame 28 and folding-member holder 32, as a unit, toward and away from the table plate 14.

Figure 3:
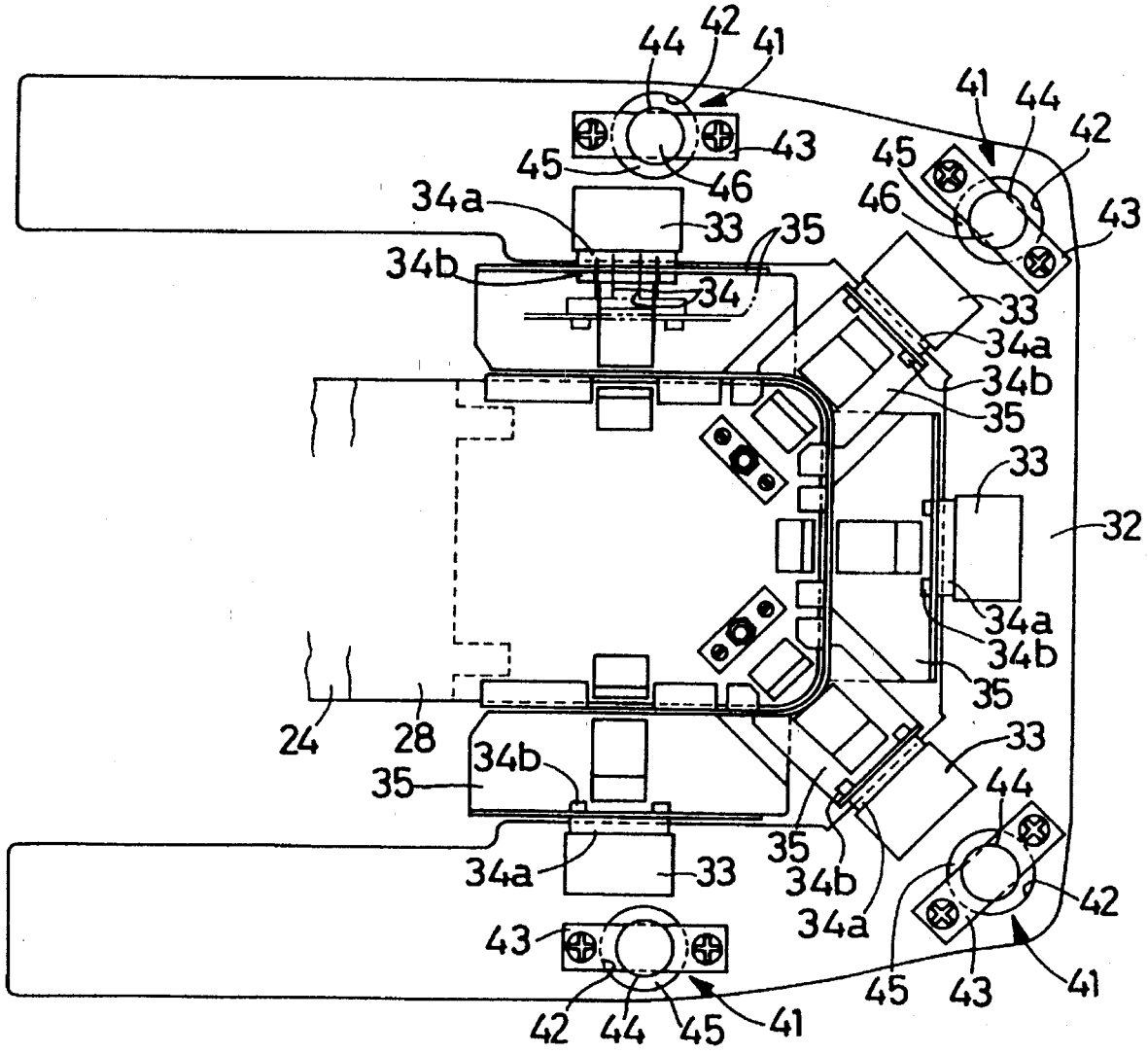
FIG. 3 is a plan view of the neighborhood of a work-sheet support plate of the retaining apparatus of FIG.

The work-sheet retaining apparatus 10 further includes four clearance adjusting devices 41 mounted on the folding-member holder 32, as shown in FIGS. 2 and 3. The clearance adjusting devices 41 serve for improving the accuracy of folding of the pocket cutting P.

The folding-member holder 32 includes four holes 42 each formed through thickness thereof, outside of the fourth air cylinders 33 associated with the work-sheet folding members 35. A bridge member 43 bridges each of the four holes 42, and is fastened to the folding-member holder 32 by screws. Each of the four bridge members 43 has an internally threaded portion engaged with an externally threaded portion of an adjusting screw 44. Thus, each of the four adjusting screws 44 is vertically adjustable. An abutment plate 45 is fixed to the bottom end of each adjusting screw 44, and a knob 46 is fixed to the top end of the same 44. A rock nut 47 fits on an intermediate portion of each adjusting screw 44 above a corresponding bridge member 43. The amount of clearance between the folding-member holder 32 and the table plate 14 may be adjusted by rotating the knobs 46 of the clearance adjusting devices 41.

Referring next to FIG. 4, there is shown a control device 50 of the present sewing system 8. The control device 50 controls the respective operations of the first to fifth air cylinders 21, 22, 29, 33, 36, the sewing machine 11, and a vacuum pump 67 (described later), for automatically attaching, by sewing, the pocket P to the front body W. The vacuum pump 67 serves for producing air suction to the work-sheet support plate 24 and thereby retaining the support plate 24 on the upper surface of the table plate 14.

The control device 50 is essentially constituted by a well-known microcomputer including a central processing unit (CPU) 51, a read only memory (ROM) 52, a random access memory (RAM) 53, an input and output (I/O) port 54, and bus 55 connecting the CPU 51, ROM 52, RAM 53, and I/O port 54 to each other. The control device 50 further includes first to fifth drive circuits 56, 57, 58, 59, 60 to operate first to fifth air valves 48*a* 48*b*, 48*c*, 48*d*, 48*e* and thereby extend and retract the first to fifth air cylinders 21, 22, 29, 33, 36, respectively, and sixth to eighth drive circuits 61, 62, 63 to operate the main motor 64, work-sheet feeding and pressing device 65 (FIG. 4), and vacuum pump 67, respectively. The work-sheet feed/press device 65 includes an X and a Y feed motor (not shown) for displacing the work-sheet feed arm 17 or presser plate 19 in the X and Y directions (FIG. 1), respectively, and an air cylinder (not shown) for pivoting the feed arm 17 about a horizontal axis to press the presser plate 19 on the work sheets P, W on the upper surface of the table 14 or bed 13.

A sewing start and stop (S/S) command switch 68 and an up and down (up/down) command switch 69 are connected to the I/O port 54 of the control device 50. The S/S command switch 68 is operable by an operator to start and stop the sewing operation of the sewing machine 11. The up/down command switch 69 is operable to input command data to pivot the work-sheet support plate 24, work-sheet folding frame 28, and folding-member holder 32, as a unit, toward and away from the table plate 14. The control device 50 starts the respective operations in response to the command data supplied from the two switches 68, 69.

The sewing S/S command switch 68 is provided on an operator's panel (not shown) disposed alongside the table 14, while the up/down command switch 69 is provided below the sewing machine 11, in the form of a foot switch operable by a foot of the operator. An air pump 70 supplies the first to fifth air valves 48*a* to 48*e* with pressurized air, Pa, via piping (not shown) after having been regulated by a pressure regulator 72. The first to fifth air valves 48*a*–48*e* are also connected to atmosphere, A, as shown in FIG. 4.

The control device 50 constructed as described above starts, responsive to operation of the sewing S/S command switch 68, for driving the first to fifth air cylinders 21, 22, 29, 33, 36, main motor 64, and work-sheet feed/press device 65, as described below, and thereby attaching the pocket P to the front body W.

Upon operation of the S/S command switch 68, the control device 50 drives the first to fifth air cylinders 21, 22, 29, 33, 36 to superpose the pocket cutting P on the front-body cutting W in the previously described steps of FIGS. 6(*a*) through 6(*e*). Subsequently, in the step of FIG. 6(*f*), the control device 50 operates the work-sheet feed/press device 65 to press the work-sheet presser plate 19 on the pocket cutting P being retained on the work-sheet support plate 24. Consequently, the pocket cutting P and the support plate 24 are pressed on the front-body cutting W provided on the table plate 14. Then, the control device 50 stops the air-suction operation of the vacuum pump 67 and drives the second air cylinder 22 to retract the support plate 24 away from the pocket cutting P. Further, the control device 50 drives the feed/press device 65 to move the presser plate 19 together with the cuttings P, W being pressed thereby, to the stitch-forming position of the sewing machine 11 directly below the sewing needle 16a. Subsequently, the control device 50 drives the main motor 64 to operate the sewing machine 11, and concurrently drives the feeding and pressing device 65 to move the presser plate 19 in the X and Y directions. Thus, the pocket P is attached by sewing to the front body W. Detailed explanation of the sewing control of a similar sewing machine is provided in the previously-identified U.S. Pat. No. 4,821,659, and further description of the operation of the sewing machine 11 is omitted.

As shown in FIG. 2, the table plate 14 has a multiplicity of first holes 83 formed through thickness thereof. The first holes 83 are opposed to the work-sheet support plate 24. An air chamber 85 is provided below the table plate 14, in air communication with the support plate 24 via the first holes 83. The air chamber 85 also communicates with the vacuum pump 67 via piping 87.

Figure 5:
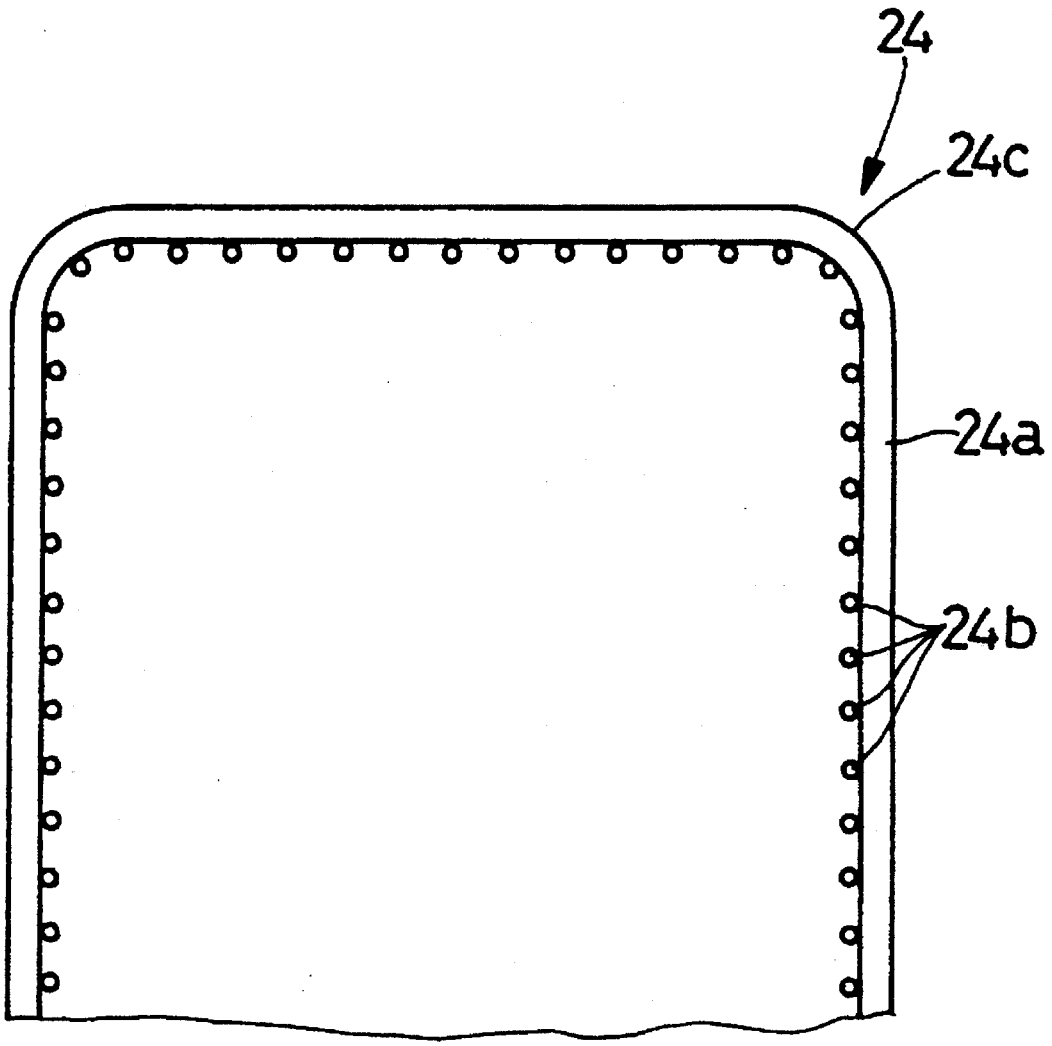
FIG. 5 is a plan view of the work-sheet support plate of FIG. 3.
Figure 6A:
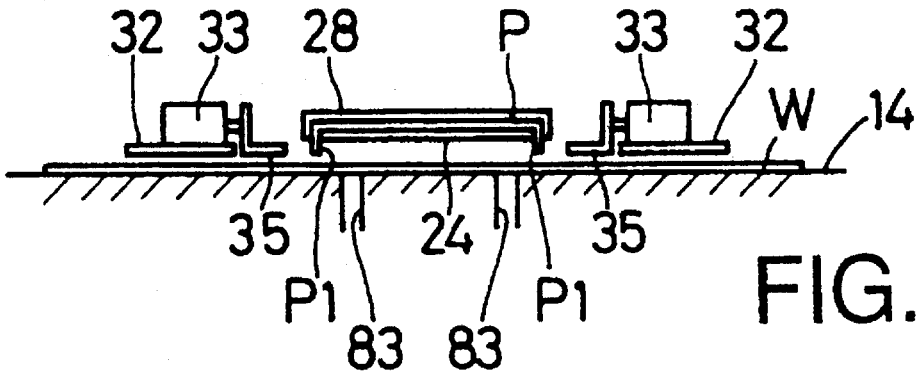
Figure 6B:
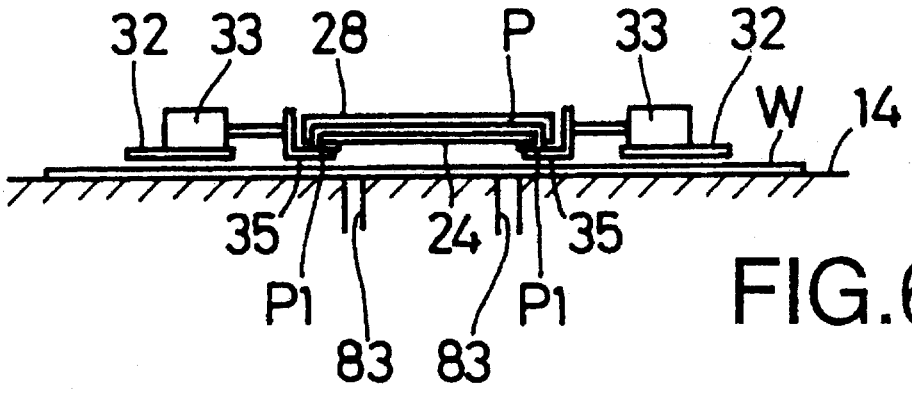
Figure 6C:
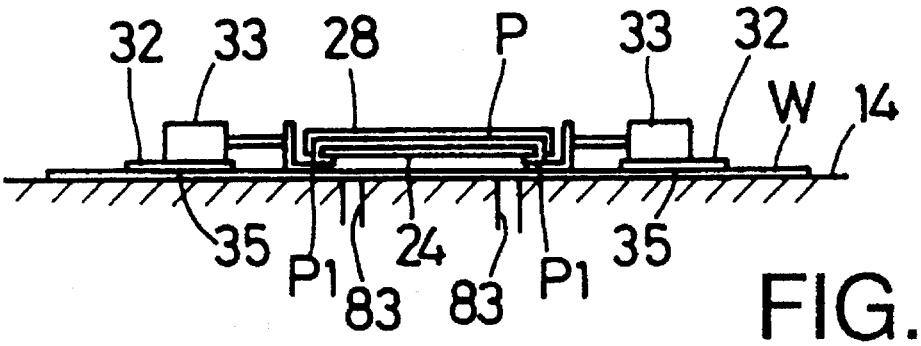
Figure 6D:
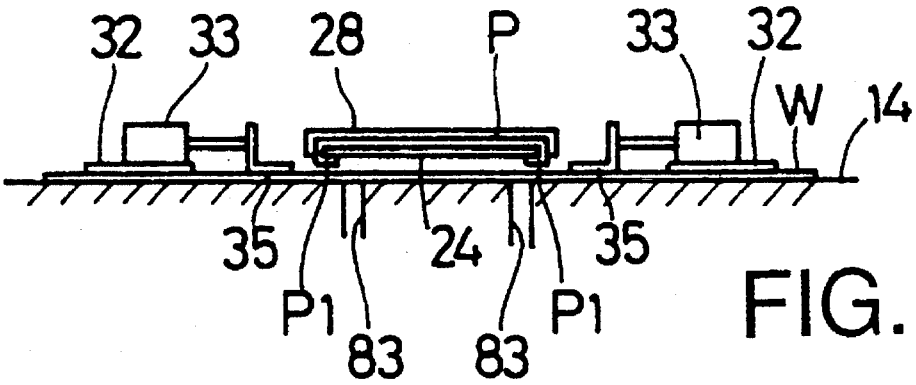
Figure 6E:
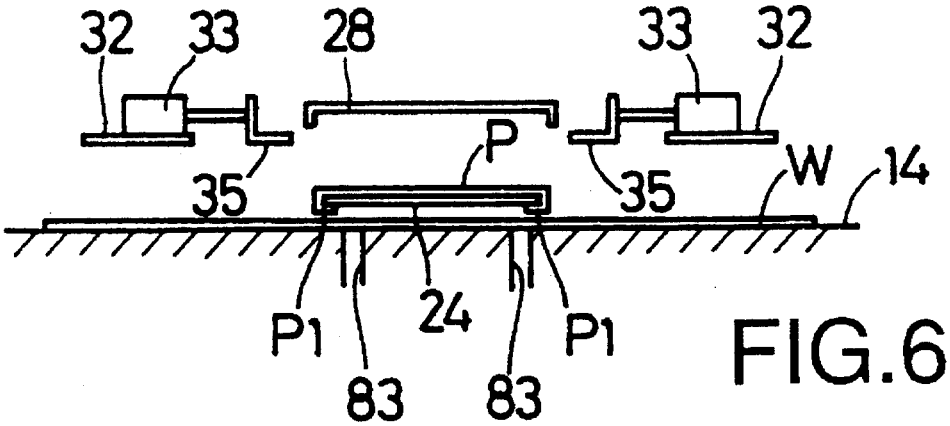
Figure 6F:
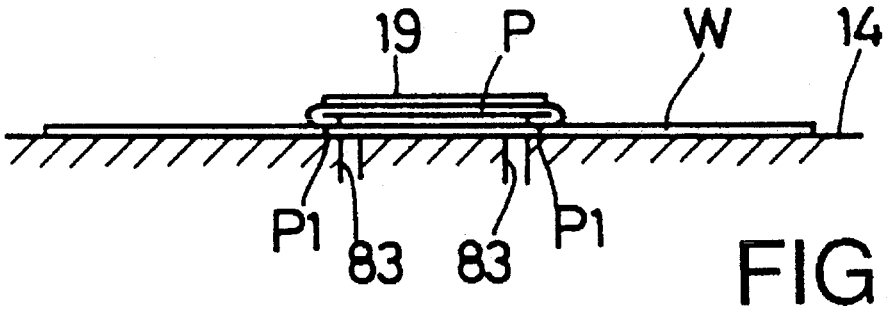

As shown in FIG. 5, the work-sheet support plate 24 includes, along three sides of the rectangular shape thereof, a tapered, outer peripheral portion 24*a* which serves for preventing the thickness of the support plate 24 from adversely affecting the folded peripheral portion P1 of the pocket cutting P. The tapered peripheral portion 24*a* is continuously formed along two lengthwise sides and one widthwise side of the rectangular support plate 24. The support plate 24 has a multiplicity of second holes 24*b* which are formed through thickness of the support plate 24 and equidistantly from each other along and inside the tapered peripheral portion 24*a*. As shown in FIG. 2, the second holes 24*b* are so positioned as to contact the outer peripheral portion P1 of the pocket cutting P folded onto the lower surface of the support plate 24. The second holes 24*b* has a diameter falling in the range of 0.3 to 4.0 mm, preferably 0.8 to 2.0 mm. If the diameter of the holes 24b is smaller than the lower limit, 0.3 mm, the sucking force exerted to the work sheet P by the vacuum pump 67 through the holes 24*b* is excessively reduced. Additionally, it will be very difficult to form such small-diameter holes in the support plate 24. A plurality of support plates 24 each of which has identical second holes 24*b* with a corresponding one of different diameters may be employed to sew a corresponding one of various sorts of materials (e.g., thick, thin, dense, or coarse) as the work sheets P, W. As the diameter of the holes 24*b* decreases, the number of holes 24*b* formed increases.

There will be described the operation of the work-sheet retaining apparatus 10 constructed as described above. The control device 50 drives the vacuum pump 67 during the steps shown in FIGS. 6(*c*) through 6(*e*). The vacuum pump 67 sucks air from above the table plate 14 through the piping 87, air chamber 85, and first holes 83, thereby drawing the work-sheet support plate 24 toward the table plate 14 and retaining the support plate 24 on the table plate 14. Thus, the folded peripheral portion P1 of the pocket cutting P is pinched with sufficient force between the support plate 24 and the table plate 14, so that the degree of immovability of the pocket cutting P is increased on the support plate 24. When the support plate 24 is retained on the table plate 14 by air suction of the vacuum pump 67, air is simultaneously sucked by the vacuum pump 67 from above the support plate 24 through the second holes 24*b* as well as the piping 87, air chamber 85, and first holes 83. Thus, the inner portion of the pocket cutting P directly supported on the upper surface of the support plate 24 is retained by air suction on the support plate 24. Thus, the degree of immovability of the pocket cutting P is further improved, so that the pocket cutting P is effectively prevented from moving out of position on the support plate 24.

In the present embodiment, the second holes 24*b* are provided at positions where the second holes 24*b* are to engage the folded peripheral portion P1 of the first work sheet P. Thus, the second holes 24*b* effectively contribute to keeping the profile or contour of the first work sheet P whose outer peripheral portion P1 is folded back on the second work sheet W. The conventional work-sheet retaining apparatus as previously described suffers from the problem that a smaller radius of curvature of an arcuate corner of a work-sheet support member thereof corresponding to an arcuate corner 24*c* (FIG. 5) of the support plate 24 more likely causes a corresponding portion of a work sheet supported thereon to move or wrinkle. In contrast thereto, in the present embodiment, the air sucked through the second holes 24*b* contributes to keeping in position or shape the outer peripheral contour of the pocket cutting P. Therefore, even though the radius of curvature of the arcuate corner 24*c* of the support plate 24 may be very small, the pocket cutting P is effectively prevented from wrinkling.

While the present invention has been described in its preferred embodiment, the present invention may otherwise be embodied.

Referring to FIG. 7, there is illustrated a work-sheet support plate 90 used in place of the support plate 24 of FIG. 5. The support plate 90 is constituted by a first rectangular metal plate 91 bent along four sides thereof, and a second rectangular metal plate 92 welded to the first metal plate 91 to seal the same 91. Thus, a hollow space 93 is provided inside the support plate 90. The welding method may be electric resistance welding such as spot welding. The second metal plate 92 has a plurality of holes 94 corresponding to the second holes 24*b* of the support plate 24. The first metal plate 92 has one or more communication holes 95. When the vacuum device 67 sucks air, the air above the support plate 90 is sucked through the holes 94, hollow space 93, and communication holes 95, so that the support plate 90 is drawn toward the table plate 14 and retained thereon. Alternatively, without forming the holes 95 in the first metal plate 91, it is possible to bend only three sides of the first plate 91 and seal the first plate 92 with the second plate 91. In the latter case, the remaining one side of the first plate 91 is open to communicate with the vacuum pump 67.

Although in the illustrated embodiments the work-sheet retaining apparatus 10 automatically folds the outer peripheral portion P1 of the work sheet P supported on the support plate 24, 90, by actuating the air cylinders 21, 22, 29, 33, 36, the retaining apparatus 10 may be modified to retain, on the support plate 24, 90, a work sheet whose outer peripheral portion has been folded back manually by an operator. In this case, too, the work sheet is surely retained on the support plate 24 by air suction of the vacuum pump 67 through the holes **24*b* or 93–95 formed in the support plate 24, 90, so that the work sheet is effectively prevented from moving out of position on the support plate 24, 90**.

While in the illustrated embodiments the holes **24*b*, 94 are formed in the outer peripheral portion of the support plate 24, 90, it is possible to additionally form similar holes in the central portion of the support plate 24, 90. The work sheet P is effectively retained on the support plate 24, 90, and the degree of immovability of the work sheet P on the support plate 24, 90 is improved. The top openings of the holes 24*b*, 94 to engage the work sheet P may be rounded to reduce the friction thereof with the work sheet P. The holes 24, 94 may have various cross-sectional shapes such as circular or elongate. A smaller number of elongate holes 24*b*, 94 extending in the direction in which the support plate 24, 90 is removed away from the work sheet P by the air cylinder 22**, are advantageous to reduce the overall friction with the work sheet P. The work sheets P, W may be various sorts of sheets such as cloth, fabric, leather, or synthetic-resin sheet.

The work-sheet folding frame 28 may be provided with third holes similar to the holes **24*b*, 94. In this case, it is preferred that, with the folding frame 28 being pressed on the work-sheet support plate 24, 90, the third holes be formed at positions offset from, i.e., not aligned with, the holes 24*b*, 94 of the support plate 24, 90, for preventing the third holes from adversely affecting the air suction of the vacuum pump 67. The air sucked through the third holes contributes to retaining the work sheet P on the support plate 24, 90, and the provision of the third holes facilitates the removal of the folding frame 28 from the work sheet P. Alternatively, the folding frame 28 may be constituted by three side portions only, simply for the function of folding downward the outer peripheral portion P1 of the work sheet P. In the latter case, the central area of the folding frame 28** is hollow and has no third holes as described above.

It is to be understood that the present invention may be embodied with other changes, improvements, and modifications that may occur to those skilled in the art without departing from the scope and spirit of the invention defined in the appended claims.

What is claimed is:

1. A work-sheet retaining apparatus for retaining a work sheet on a support plate, the support plate having opposite major surfaces, the work sheet being placed on one of the two major surfaces of the support plate, the apparatus comprising:

a table which is positioned adjacent to the other major surface of said support plate, an excess of the work sheet which overflows said one major surface of the support plate being folded and held between the other major surface of the support plate and said table;

said support plate having at least one air passage opening in said one major surface; and a suction device which sucks air through said at least one air passage of said support plate so as to retain an inner portion of the work sheet supported by said one major surface on said one major surface.

2. A work-sheet retaining apparatus according to claim 1, wherein said table comprises a table plate having at least one first hole formed through a thickness thereof, said support plate being disposed on one side of said table plate, said support plate having said at least one air passage comprising at least one second hole formed through a thickness thereof, said suction device being disposed on the other side of said table plate, communicating with said at least one first hole of said table plate, and sucking air through said at least one first hole of said table plate and said at least one second hole of said support plate so as to retain said support plate on said table plate and simultaneously retain said inner portion of the work sheet on said one major surface of the support plate.

3. An apparatus according to claim 2, wherein said support plate bas a plurality of said second holes.

4. An apparatus according to claim 2, wherein said support plate has a plurality of said second holes consisting of a plurality of holes formed along a peripheral edge of the support plate.

5. An apparatus according to claim 2, wherein said support plate has a rectangular shape and has a plurality of said second holes formed along three sides of the support plate.

6. An apparatus according to claim 2, wherein said at least one second hole of said support plate has a circular cross section whose diameter falls in a range of 0.3 to 4.0 mm.

7. An apparatus according to claim 1, further comprising:

a displacing device which removes said support plate from the work sheet; and a pressing device which presses the work sheet on said table while said support plate is removed from the work sheet by said displacing device.

8. An apparatus according to claim 1, further comprising:

a first folding device which folds said excess of the work sheet which overflows said one major surface of said support plate, onto at least one side surface of the support plate; and a second folding device which folds said excess of the work sheet folded on said at least one side surface of said support plate, onto said other major surface of the support plate.

9. A process of retaining a work sheet and forming stitches on the work sheet, comprising the steps of:

placing the work sheet on one of opposite major surfaces of a support plate, the support plate having at least one air passage opening in said one major surface;

folding and inserting an excess of the work sheet which overflows said one major surface of said support plate, held between the other major surface of the support plate and a table positioned adjacent to said other major surface;

sucking air through said at least one air passage of said support plate so as to retain an inner portion of the work sheet supported by said one major surface, on said one major surface; and forming said stitches on the work sheet.

10. A process according to claim 9, further comprising the steps of:

placing, on said table, a second work sheet different from a first work sheet providing the work sheet placed on said support plate; and superposing the first work sheet on the second work sheet, wherein the step of forming said stitches comprises forming said stitches into the first and second work sheets to attach the first work sheet to the second work sheet.

11. A process according to claim 9, further comprising the step of disposing said support plate on one side of a table plate providing said table, and disposing said suction device on the other side of said table plate, wherein the step of sucking air comprises sucking air through at least one first hole formed through thickness of said table plate and at least one second hole formed through a thickness of said support plate so as to retain said support plate on said table plate and simultaneously retain said inner portion of the work sheet on said one major surface of the support plate.

12. A process according to claim 9, further comprising the steps of:

removing said support plate from the work sheet; and pressing, using a pressing device, the work sheet on said table while said support plate is removed from the work sheet, wherein the step of forming said stitches comprises forming, using a stitch-forming device, said stitches into the work sheet being pressed by said pressing device after said support plate has been removed from the work sheet.

13. A process according to claim 12, further comprising the step of moving, using a moving device, the work sheet from a first position where the work sheet is pressed by said pressing device, to a second position where the work sheet is sewn by said stitch-forming device.

14. A process according to claim 13, wherein the step of pressing the work sheet comprises pressing, using a presser plate providing said pressing device, the work sheet on said table, and the step of moving the work sheet comprises moving said presser plate providing said moving device, together with the work sheet being pressed thereby on said table, from said first position to said second position.

* * * * *